United States Patent [19]

Einhorn

[11] 4,148,101

[45] Apr. 3, 1979

[54] HANDLING LATEX PAINT

[76] Inventor: Stephen Einhorn, 8049 N. Links Way, Milwaukee, Wis. 53217

[21] Appl. No.: 880,434

[22] Filed: Feb. 23, 1978

[51] Int. Cl.[2] ..... B01F 5/12

[52] U.S. Cl. ..... 366/262; 366/251

[58] Field of Search ..... 366/145, 146, 147, 148, 366/149, 248, 249, 251, 262, 250, 136, 137, 605

[56] References Cited

U.S. PATENT DOCUMENTS

| | | | |
|---|---|---|---|
| 2,610,041 | 9/1952 | Stahl | 366/605 |
| 3,411,756 | 11/1968 | Ziegler | 366/251 |
| 3,704,007 | 11/1972 | Kroeger | 366/248 |
| 3,862,748 | 1/1975 | Grise | 366/248 |
| 4,044,079 | 8/1977 | Tveit | 366/262 |

*Primary Examiner*—Edward J. McCarthy

*Attorney, Agent, or Firm*—Andrus, Sceales, Starke & Sawall

[57] ABSTRACT

Latex paints are shipped in bulk tanks or containers generally in excess of 200 pounds from the factory to the retailer with substantially constant stirring and temperature control. The retailer is thus enabled to dispense latex paints of uniform quality in smaller cans taken from bulk supplies.

Tanks, tote bins and other bulk containers are provided with constant stirring apparatus and also temperature control devices.

9 Claims, 6 Drawing Figures

Fig. 1
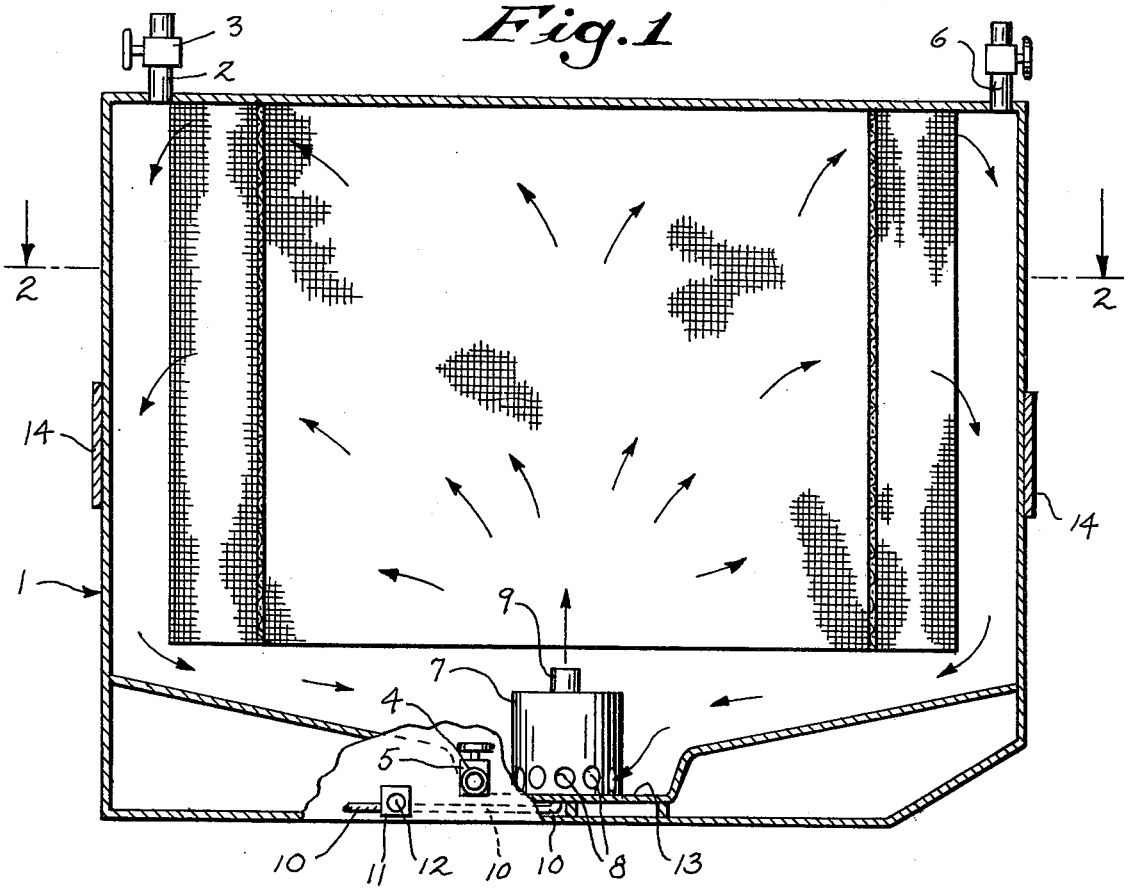
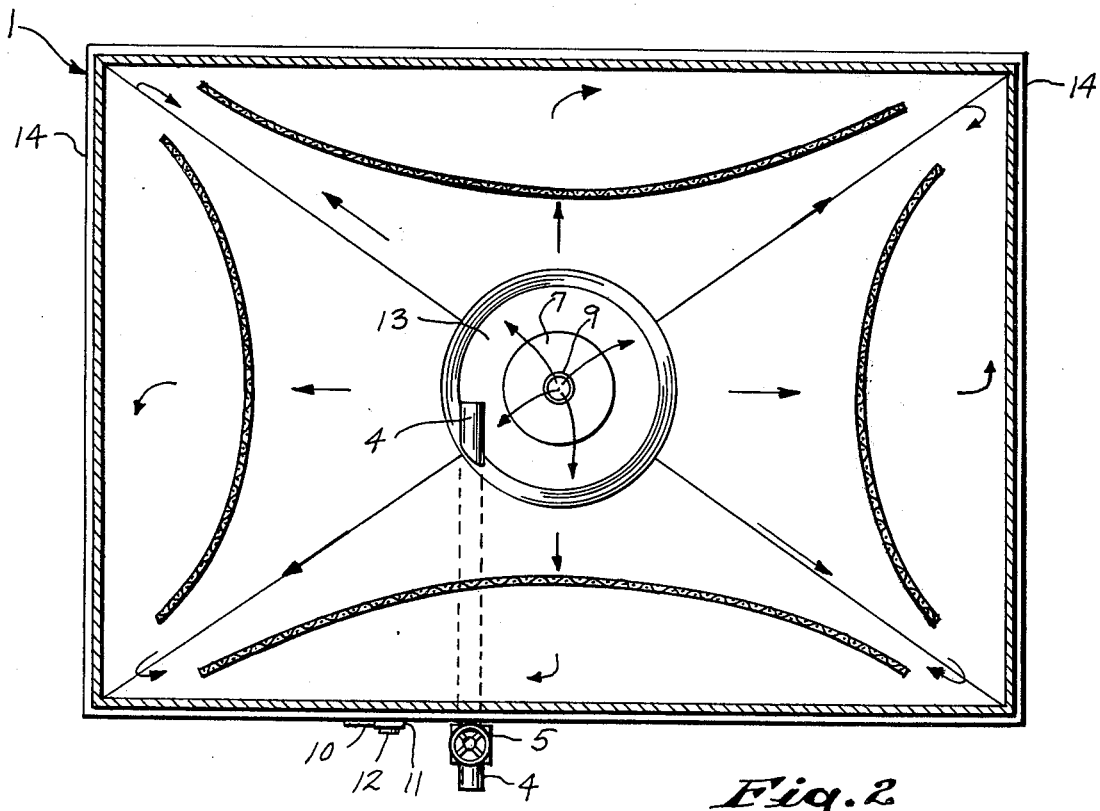
Fig. 2

HANDLING LATEX PAINT

BACKGROUND OF THE INVENTION

This invention relates to the handling of latex paints to maintain uniformity, to better conserve the paint, and to reduce costs in manufacturing, shipping and storing.

Oil base paints have been generally marketed in small sized containers from the manufacturer to the retailer, and from the retailer to the customer in the same containers without affecting the quality of the paint or its uniformity.

When latex paints came on the market it was natural to continue this same general marketing system which was believed to be most desirable from a commercial standpoint. With this system the manufacturer had a ready means of advertising by the use of specially designed labels on each can, and the use of costly throw-away paint cans became well developed.

Now, with greater attention to waste and cost reduction, questions should be raised concerning the desirability of costly throw-away containers versus inexpensive refillable containers.

Within the manufacturing and storage of consumer paints, the greatest labor and machinery expense has been allocated to the filling of paint batches into small containers, and the subsequent packaging into cartons and storage in cans, cases or pallets. If these expenses, along with the labor and extensive shipping expenses of selecting, packaging, marking and delivering in small units, could be eliminated; a significant saving to the consumer could develop.

In addition, the latex paint marketing system referred to has raised certain technical problems which have not been fully answered. For instance, since latex paints consist primarily of inorganic pigments and a resin base with a water solvent, they are susceptible to damage from freezing, stratification and skin formation; all of which are chemical processes that tend to reduce the uniformity and workability of the paint.

Manufacturers have generally attempted to overcome these difficulties in the past by the addition of glycol compositions to reduce damage from freezing, and the addition of stabilizers and viscosity control agents to reduce the tendency to stratify and to form skins. However, these additives tend to dilute the paint, produce side effects and add cost.

The relatively small can sizes normally usable by retail paint consumers can be made sufficiently strong to withstand pressures of thermal expansion with a minimum of air space, thus reducing skin formation and water evaporation.

Any attempt to employ large tanks, tote bins and bulk containers in shipment of paint encounters the necessity for sealing the container with a larger air space therein to provide for thermal expansion and contraction of the paint, raising a problem of evaporation and skin formation. Furthermore, the general size of these bulk handling facilities tends to encourage stratification and non-uniformity of the paint.

The skin formation is not readily assimilated in the paint, and the stratification is difficult to overcome fully by subsequent mixing.

Various mechanical mixing devices have been provided for drums of paint as exemplified in early U.S. Pats. No. 1,521,564, No. 2,146,372, No. 2,469,557 and No. 2,143,511, and the ordinary paint paddle is readily available.

Also, it has been suggested that the tinting portion of the manufacturing process be transferred to the retailer by equipping the retailer with equipment that facilitates the metering of small additions of color to a paint base, as exemplified in the Hexter U.S. Pat. No. 2,068,646 and Hoekstra et al U.S. Pat. No. 4,046,287.

SUMMARY OF THE INVENTION

In carrying out the present invention, latex paints are shipped in bulk containers such as drums, generally in excess of 200 pounds; tote bins; tank trucks, and the like to the retailer where the paint remains stored in bulk and is dispensed in smaller quantities to retail customers either in their own cans, or in small inexpensive containers provided by the retailer.

In order to maintain the uniformity and desired freshness of the paint, the bulk containers are sealed and provided with constant stirring devices to prevent stratification of the paint and undue skin formation during transportation and storage.

The problem of air space for thermal expansion and contraction can be reduced to a minimum and practically eliminated where it is possible to maintain the paint at an approximate constant temperature such as 77° F., the temperature generally employed for viscosity measurements of paints. The temperature may vary considerably with constant stirring, but it is preferred to maintain it in the range of from 60° to 85° in order to eliminate the cost of stabilizing additives.

In carrying out the invention it is possible to reduce or eliminate such anti-freeze additives as ethylene or propylene glycol, and other stabilizer additives such as hydroxy ethyl cellulose or methyl cellulose; thereby reducing the cost of the paint and increasing its purity.

The stirring apparatus employed may be any suitable mechanical stirring or mixing device that does not tend to aerate the paint. The objective generally will be to keep the paint flowing in a path that prevents any undue stagnation in any part of the storage container so that gravity stratification will be prevented.

The velocity of the flow need not be high, and it should be just enough to maintain uniformity of both temperature and consistency throughout the body of the paint. In the mainstream of paint flow the velocity may be of the order of from a fraction of one to five feet per minute.

BRIEF DESCRIPTION OF THE DRAWINGS

The best mode presently contemplated for carrying out the invention is illustrated in the accompanying drawings in which:

FIG. 1 is a longitudinal section of a bulk transportation and storage tank of the tote-bin type with a submersible motor-pump unit and suitable baffles for constant mixing of the paint;

FIG. 2 is a section of the tank taken on line 2—2 of FIG. 1;

DESCRIPTION OF THE PREFERRED EMBODIMENTS

Figure 3:
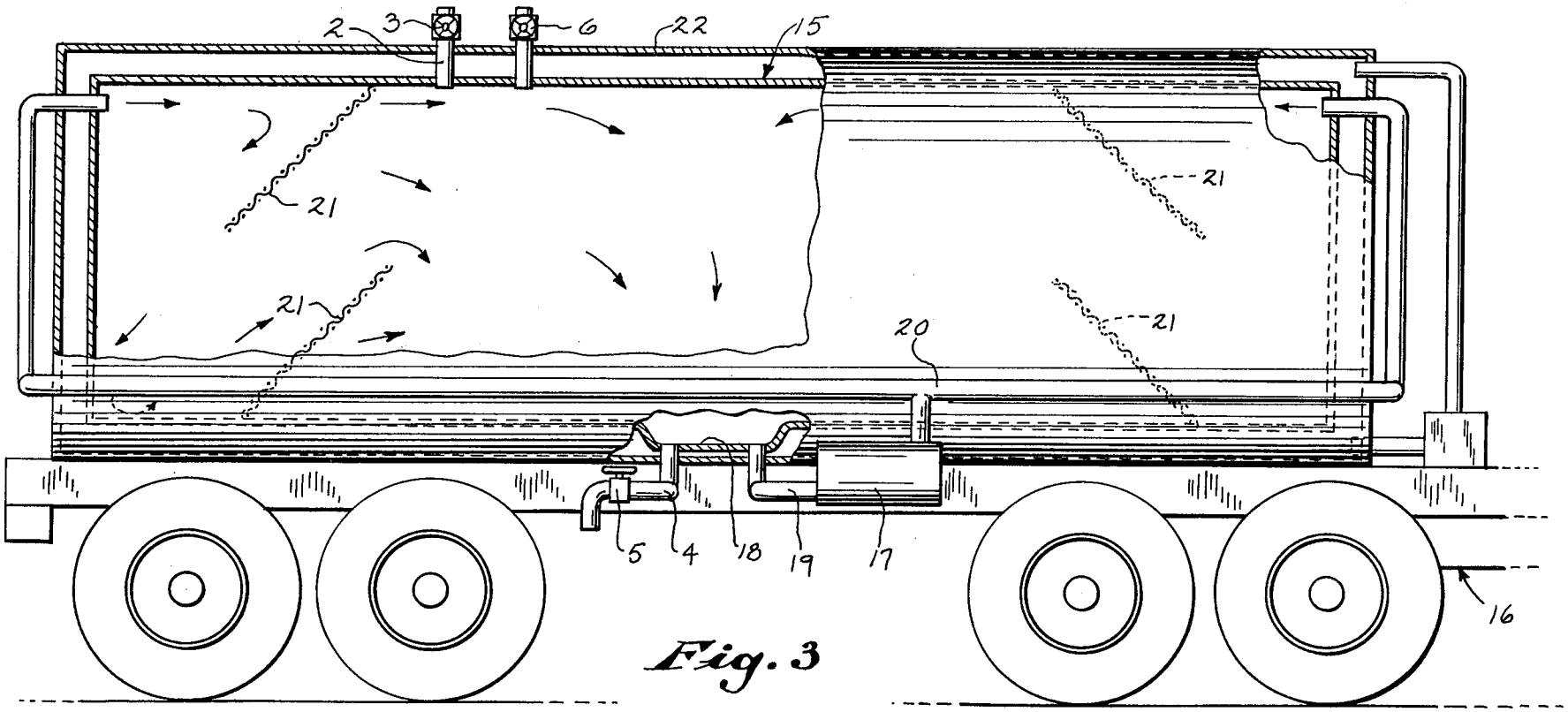
FIG. 3 is a side elevation of a transportation tank having an external motor-pump unit for constantly circulating the paint in the tank, and with parts broken away to show details.

With reference to the tote-bin type of transportation and storage tank illustrated in FIG. 1, the tank 1 is completely closed and has an inlet pipe 2 with a valve closure 3 therefor for filling purposes, and a discharge or drain pipe 4 also with a valve closure 5 for dispensing paint from the tank.

A suitable normally closed air vent 6 at the top of the tank is provided to admit air to the tank as valve 5 drains paint from the tank. For this purpose the vent 6 and valve 5 may be manually operated in the desired sequence, or may be simultaneously opened and closed by suitable power means, not shown.

The tank 1 may be circular, rectangular or of any suitable configuration. Generally, tote bins for this purpose will be as high as they are wide.

A small submersible motor-pump unit 7 is disposed centrally on the bottom of the tank with its axis vertical.

A series of inlet openings 8 are spaced around the circumference of the unit 7 near the bottom of tank 1, and a vertical discharge opening 9 is provided to produce a flow of paint upwardly in the center of the tank, radially outward at the surface of the paint, downwardly adjacent the walls of the tank and radially inward to the pump at the bottom of the tank.

The movement of the paint engendered by the motor-pump unit 7 effects a complete and constant mixing of the paint in all regions of the tank 1.

Suitable current supply is provided for unit 7 by the electrical cable 10 going to a connector 11 with a speed adjusting switch 12.

In order to be able to dispense substantially all of the paint within tank 1, the bottom of the tank may be made generally conical to provide a reasonably small central sump 13 from which drain pipe 4 leads and in which the unit 7 is disposed.

A suitable heat exchange means preferably shown as an electric heating element 14 may be disposed within tank 1 or, as illustrated, may be preferably disposed in a band extending peripherally of the tank on the outside and in generally thermal contact therewith to heat the same as in cold weather.

With reference to the larger transportation tank illustrated in FIG. 3, the tank 15 is generally circular or eliptical in transverse section and extends horizontally as on a truck trailer 16.

In this instance the inlet pipe 2, valve 3, drain pipe 4, valve 5 and air vent 6 are approximately the same as for the tank 1.

The paint in tank 15 is kept constantly in circulation by a motor pump unit 17 outside the tank and having suitable pipe connections with the tank.

For this purpose a small drain sump 18 centrally of the tank 15 at the bottom receives the connection for drain pipe 4 and also for the pipe 19 connecting the tank to the inlet of the pump unit 17.

The return pipe 20 from motor pump unit 17 to tank 15 is provided with manifold branches discharging into the tank 15 at the ends and at various desirable locations to maintain the desired movement of the paint.

In order to maintain a desired distribution of the flow pattern within the tank 15 baffles 21 are provided as desired.

The tank 15 may be provided with suitable heat exchange means such as the jacket 22 in which a suitable fluid heating media from the truck engine is circulated to heat the walls of the tank in cold weather. In hot weather, where possible, a refrigerant or other cooled media may be supplied to jacket 22 to prevent the paint from reaching an undesirable temperature.

Figure 4:
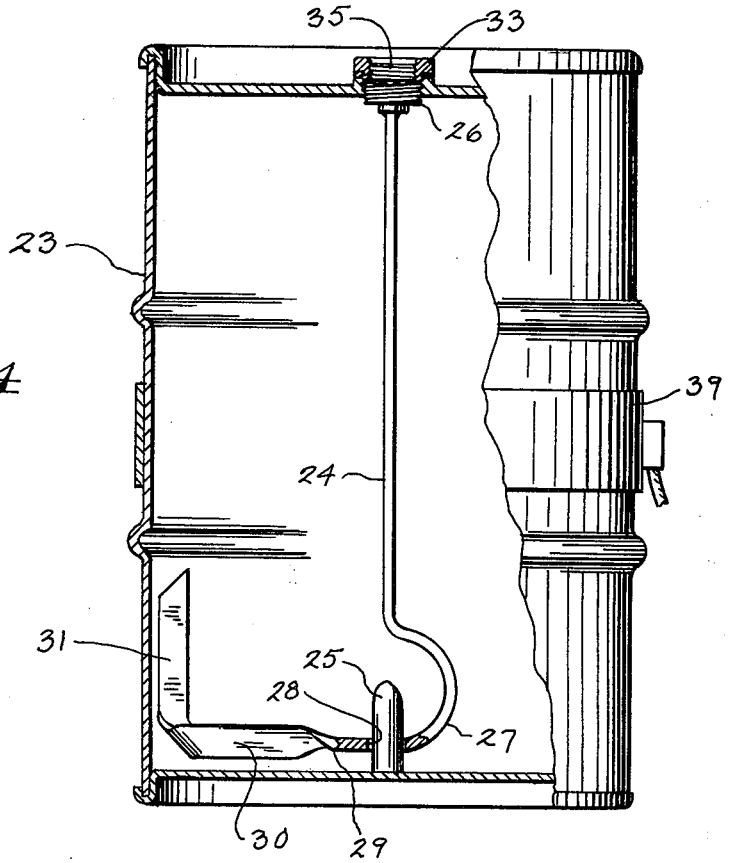
FIG. 4 is a vertical section of a drum having a motor driven stirring device therein.
Figure 5:
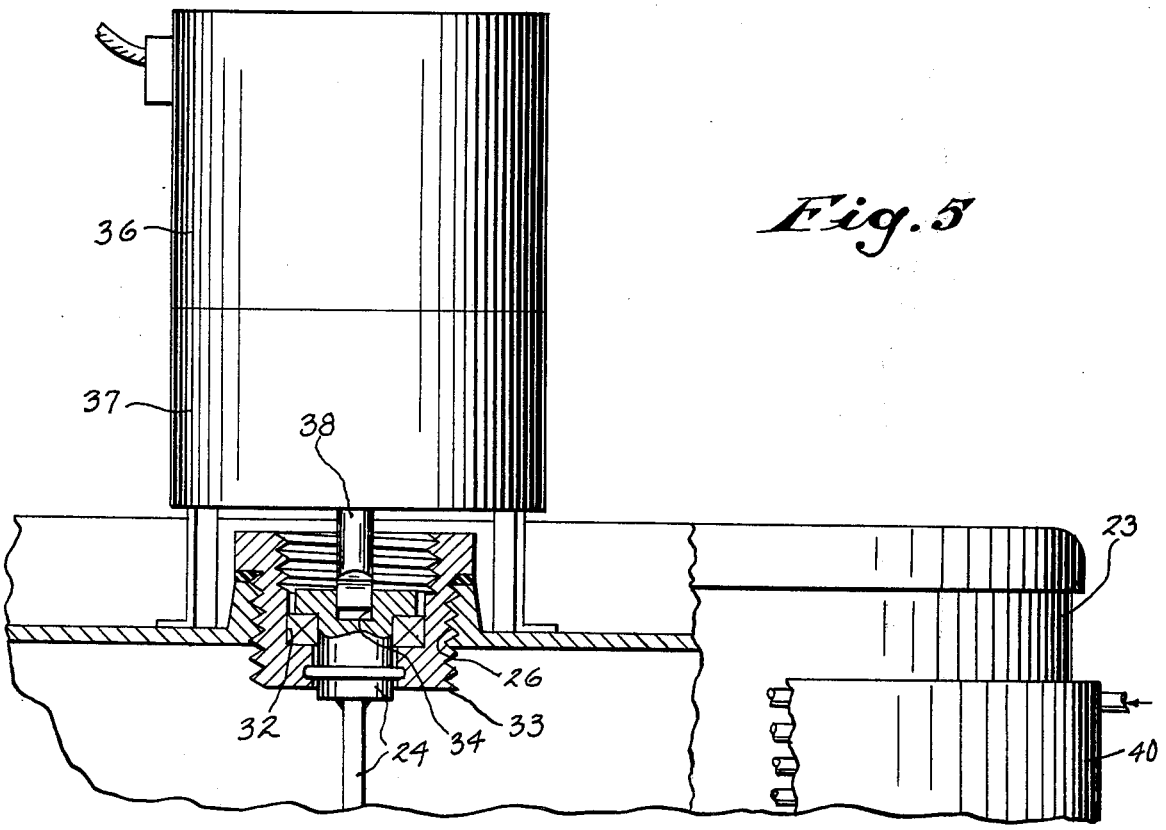
FIG. 5 is a detailed section of the upper end of the drum of FIG. 4 showing the attachment of a driving unit thereto and an alternate form of heat exchanger.

With reference to the drum 23 illustrated in FIG. 4, a mechanical stirring device 24 is mounted axially of the drum on a suitable bearing pin 25 centrally of the bottom of the drum, much as disclosed in U.S. Pat. No. 2,146,372 referred to above.

The stirring device 24 comprises a twisted flat metal strip extending downwardly from the bung opening 26 in the top of drum 23 and having its lower end laterally offset with a return bend 27 having an opening 28 receiving pin 25.

The return bend 27 continues beyond pin 25 to provide an arm 29 extending radially of the drum and which is twisted to present a paddle blade 30 to the paint as the arm rotates about pin 25.

The outer end of arm 29 is twisted and bent upwardly to provide a vertically extending paddle 31 to stir the paint near the outer walls of the drum and provide an upward flow along the wall.

The upper end of device 24 is mounted in a journal bearing 32 in the bung closure 33 and has a rectangular recess 34 centrally of the end. A cap 35 is threaded over the closure 33 when the device 24 is not being driven.

In order to drive the device 24 the cap 35 is removed and a small fractional horse power electric motor 36 with a reduction gear unit 37 is mounted in place of the cap on closure 33.

The output shaft 38 for the motor gears has a rectangular end that fits into the recess 34 to drive device 24.

Motor drives 36 may be available to attach to successive drums 23 in shipment and during storage at the retail level.

The drum 23 may be heated by a removable wrap around heating element 39 which may be either an electrical resistance heating unit energized from any suitable source of electricity during transportation and/or storage, or a hydraulic heating pad 40 receiving hot fluid from a suitable source.

The system of handling latex paint for marketing purposes, as described above, may employ various apparatus for its purpose.

Figure 6:
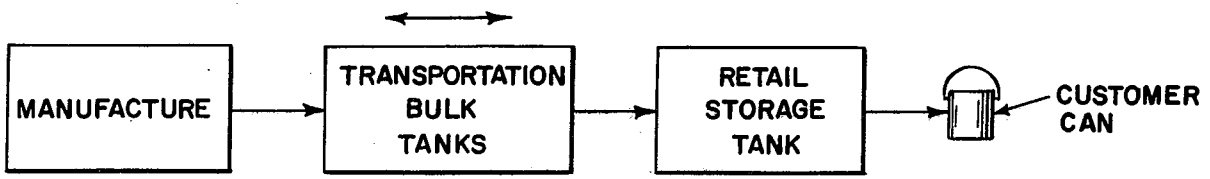
FIG. 6 is a general flow diagram of the bulk marketing system utilizing the invention.

Referring to FIG. 6, the flow diagram indicates transportation from the manufacturer to the retailer of bulk tanks filled with paint and return of empty tanks, storage of the paint in bulk tanks by the retailer and dispensing to the customers in small cans supplied by the customers.

By providing substantially constant stirring of bulk containers of paint during transportation from the factory to the retailer the former small can and label costs are eliminated and it is possible to pass the saving on to the customer, particularly where he brings his own can for receiving a select quantity of paint from the retailer.

The stirring of the paint during transportation and storage substantially eliminates or reduces loss by skin formation and stratification and reduces the need for diluting the paint with stabilizers.

Additionally the stirring of the paint during transportation and storage maintains a more uniform temperature for it, and with only a minimal heat input or cooling input in areas where freezing or overheating may occur will preserve the paint without the dilution heretofore encountered in using various additives such as glycol.

The paint thus delivered to the consumer is more pure and with less additives.

Various modes of carrying out the invention are contemplated as being within the scope of the following claims particularly pointing out and distinctly claiming the subject matter which is regarded as the invention.

We claim:

1. The handling of latex paint following the manufacture thereof comprising shipping the same to retail accounts in sealed bulk containers, and stirring the paint substantially constantly during shipment to maintain its uniformity in composition, in viscosity and in temperature.

2. The handling procedure of claim 1 and continuing to stir the paint while in bulk containers in storage by the retailer.

3. The handling procedure of claim 1 in which the temperature of the paint is additionally maintained in the range from about 60° F. to 85° F.

4. The handling procedure of claim 2 in which the temperature of the paint is additionally maintained in the range from about 60° F. to 85° F.

5. Handling apparatus for latex paint comprising a sealed bulk transportation container of paint and means to substantially constantly stir the paint in said container to maintain the same more uniform as to composition, viscosity, and temperature.

6. Handling apparatus as set forth in claim 5 and heat exchange means to maintain the temperature of the paint in the range of from about 60° F. to 85° F.

7. Handling apparatus as set forth in claim 5 in which said bulk container comprises a tote bin having a central sump in the bottom, and said stirring means comprises a submersible motor pump unit disposed vertically in said sump.

8. Handling apparatus as set forth in claim 5 in which said bulk container comprises a horizontally disposed generally round tank on a transportation vehicle, and said stirring means comprises a motor driven pump mounted on the vehicle, and means connecting said pump inlet to the drain region of said tank and connecting the pump discharge by manifold means to the opposite ends of said tank.

9. Handling apparatus as set forth in claim 5 in which said bulk container comprises a shipping drum having a central bung opening in its upper end, and said stirring means comprises a mechanical stirring paddle mounted for rotation axially of the drum, and power drive means removably attached to the drum at said bunk opening and having means interconnecting with said paddle to rotate the same.

* * * * *